US012076770B2

(12) United States Patent
Allwood et al.

(10) Patent No.: US 12,076,770 B2
(45) Date of Patent: Sep. 3, 2024

(54) WORKING OF SHEET METAL

(71) Applicant: CAMBRIDGE ENTERPRISE LIMITED, Cambridge Cambridgeshire (GB)

(72) Inventors: Julian Allwood, Cambridge Cambridgeshire (GB); Adam Nagysochacki, Upper Heyford Northamptonshire (GB); Christopher Cleaver, Cambridge Cambridgeshire (GB); Omer Music, Sarajevo (BA); Evripides G. Loukaides, Bath Bath and North East Somerset (GB)

(73) Assignee: Cambridge Enterprise Limited, Cambridge (GB)

( * ) Notice: Subject to any disclaimer, the term of this patent is extended or adjusted under 35 U.S.C. 154(b) by 128 days.

(21) Appl. No.: 17/271,816

(22) PCT Filed: Aug. 29, 2019

(86) PCT No.: PCT/EP2019/073107
§ 371 (c)(1),
(2) Date: Feb. 26, 2021

(87) PCT Pub. No.: WO2020/043832
PCT Pub. Date: Mar. 5, 2020

(65) Prior Publication Data

US 2021/0323041 A1 Oct. 21, 2021

(30) Foreign Application Priority Data

Aug. 29, 2018 (GB) ..... 1814069

(51) Int. Cl.
*B21D 19/04* (2006.01)
*B21D 5/01* (2006.01)
(Continued)

(52) U.S. Cl.
CPC ..... *B21D 19/043* (2013.01); *B21D 5/01* (2013.01); *B21D 5/06* (2013.01); *B21D 5/08* (2013.01); *B21D 22/16* (2013.01); *B21D 31/005* (2013.01)

(58) Field of Classification Search
CPC ... B21D 5/01; B21D 5/06; B21D 5/08; B21D 19/02; B21D 19/043; B21D 31/005;
(Continued)

(56) References Cited

U.S. PATENT DOCUMENTS 6,715,329 B1 * 4/2004 Hametner ..... B21D 5/02 72/220
2012/0024034 A1 2/2012 Ren et al.
2016/0158821 A1 * 6/2016 Fujii ..... B21D 22/20 72/352

FOREIGN PATENT DOCUMENTS

CN 105392575 A 3/2016
CN 106132580 A 11/2016
(Continued)

OTHER PUBLICATIONS

Horton, P.M. and Allwood, J.M. (2017): "Yield improvement opportunities for manufacturing automotive sheet metal components", Journal of Materials Processing Technology, 249 78-88.
(Continued)

*Primary Examiner* — Debra M Sullivan
*Assistant Examiner* — Matthew Stephens
(74) *Attorney, Agent, or Firm* — Quarles & Brady LLP

(57) ABSTRACT

The present invention relates to methods of working sheet metal, and sheet metal working apparatus for performing such methods. Such methods include steps of providing a sheet metal workpiece having first and second surfaces opposed to each other and at least one edge, bending the workpiece to form at least a first sidewall portion defined between the edge and a basal region, the first sidewall
(Continued)

portion thereby defining a curved fold region in the sheet metal workpiece adjacent the first sidewall portion. Following this, first anvil tool and a first forming tool are provided for contact with and constraint of the first and second surfaces of the sheet metal workpiece respectively. The forming tool and/or the anvil tool are then progressively slid along the curved fold region to cause shear material transfer in the curved fold region to further deform the curved fold region. Such methods can allow for formation of components of similar shape as made at present by deep drawing methods, but with less wastage of the starting material.

12 Claims, 11 Drawing Sheets

(51) Int. Cl.

| | |
|---|---|
| ***B21D 5/06*** | (2006.01) |
| ***B21D 5/08*** | (2006.01) |
| ***B21D 22/16*** | (2006.01) |
| ***B21D 31/00*** | (2006.01) |

(58) Field of Classification Search
CPC ..... B21D 31/00; B21D 25/02; B21D 22/16; B21D 24/005
See application file for complete search history.

(56) References Cited

FOREIGN PATENT DOCUMENTS

| | | | | | |
|---|---|---|---|---|---|
| DE | 4009466 | A1 | * | 9/1991 | ..... B21D 5/045 |
| DE | 19612239 | A1 | * | 10/1997 | ..... B21D 19/043 |
| EP | 3023168 | A1 | | 5/2016 | |
| JP | S61159225 | A | * | 7/1986 | ..... B21D 5/08 |
| JP | 09-057381 | A | | 3/1997 | |
| JP | H0957381 | A | * | 3/1997 | ..... B21D 31/005 |
| JP | 10-296345 | A | | 11/1998 | |
| KR | 20020084955 | A | * | 11/2002 | ..... B21D 19/043 |

OTHER PUBLICATIONS

International Search Report and Written Opinion, International Application No. PCT/EP2019/073107, dated Oct. 29, 2019, 15 pages.
UKIPO Search Report, GB Application No. 1814069.9, dated Jan. 31, 2019, 4 pages.
Chinese Office Action, Chinese Application No. 201980071436.0, CNIPA, dated Sep. 30, 2022, 25 pages. (with English Translation).
Second Chinese Office Action, Chinese Application No. 201980071436.0, CNIPA, dated Feb. 11, 2023, 9 pages. (with English Translation).

* cited by examiner

Shrink flange

Stretch flange

S – flange a)

b)

c)

WORKING OF SHEET METAL

RELATED APPLICATIONS

This application is a 35 U.S.C. § 371 national phase application of PCT/EP2019/073107 (WO-2020/043832-A1), filed on Aug. 29, 2019, entitled "WORKING OF SHEET METAL", which application claims the benefit of GB Patent Application No. 1814069.9, filed Aug. 29, 2018, each of which are incorporated herein by reference in entirety.

BACKGROUND TO THE INVENTION

Field of the Invention

The present invention relates to methods for working of sheet metal and to workpieces that are obtainable by such methods of working of sheet metal. The present invention also relates to sheet metal working apparatus.

Related Art

Up to half of all the sheet metal made globally each year is not used in a final product but is cut off during manufacture. Two main causes of this loss are blanking (cutting a flat shape out of the coiled up long flat sheets made in rolling mills) and trimming after deep drawing, with the latter dominating. These losses are an unavoidable by-product of these processes. Further discussion and quantification of these losses is set out in Horton and Allwood (2017).

The cost in both money and carbon emissions associated with these losses is high, although at present the process of blanking followed by deep drawing is considered to be the most efficient way to make shaped sheet metal components such as e.g. car body components. In blanking and deep drawing, a key consideration is the avoidance of wrinkling and tearing during forming.

SUMMARY OF THE INVENTION

It would be advantageous to be able to form components of similar shape as made at present by deep drawing but with less wastage of the starting material.

The present invention has been devised in order to address at least one of the above problems. Preferably, the present invention reduces, ameliorates, avoids or overcomes at least one of the above problems.

The present inventors have realised that it is possible to form suitable component shapes from sheet metal by a different process. It is recognised by the inventors that the geometrical features of any sheet-metal part can be described as a combination of the three-types of 'flange' illustrated in FIGS. 1-3: 'shrink' flanges, 'stretch' flanges and 'S' flanges. 'S' flanges can be considered to be a flange comprising a combination of a shrink flange portion and a stretch flange portion. Shrink flanges as shown in FIG. 1 may be prone to sheet thickening or buckling, whilst stretch flanges as shown in FIG. 2 may be prone to sheet thinning or edge cracking. 'S' flanges as shown in FIG. 3 may suffer from both of these problems in different regions of the flange. Up to a limit defined by the workpiece material, such flanges can be created by local indentation, thereby sacrificing material thickness for form. The challenge of sheet metal forming is therefore to create these shapes with as little thinning or unwanted material deformation as possible.

This may be achieved by moving the sheet material within its plane, i.e. by accommodating the required shape change by shearing.

Accordingly, in a first preferred aspect, the present invention provides a method of manufacturing a formed sheet metal structure, comprising the steps of:

- providing a sheet metal workpiece having first and second surfaces opposed to each other and at least one edge;
- bending the workpiece to form at least a first sidewall portion defined between the edge and a basal region, the first sidewall portion thereby defining a curved fold region in the sheet metal workpiece adjacent the first sidewall portion;
- providing a first anvil tool with a tool surface for contact with and constraint of the first surface of the sheet metal workpiece;
- providing a first forming tool with a tool surface for contact with and constraint of the second surface of the sheet metal workpiece;
- contacting the sheet metal workpiece with the anvil tool and the forming tool, and progressively sliding the forming tool and/or the anvil tool along the curved fold region to cause shear material transfer in the curved fold region to further deform the curved fold region.

The at least one edge of the sheet metal workpiece may comprise first and second edge regions, and the method may further comprise bending the workpiece to form said first sidewall portion and a second sidewall portion respectively defined between the first and second edge regions and the basal region, and to define the curved fold region intermediate the first and second sidewall portions.

The forming tool and/or the anvil tool may be progressively slid along the curved fold region in a direction away from the basal region. Additionally or alternatively, the forming tool and/or the anvil tool may be progressively slid along the curved fold region laterally to the basal region. The precise direction in which the forming tool and/or anvil tool are slid along the curved fold region will depend on a number of considerations, and may be selected as appropriate given the initial shape of the sheet metal workpiece, and the desired final shape of the formed sheet metal structure.

The above method (otherwise termed herein a "Folding-Shearing" method) may allow for production of a formed sheet metal structure which requires minimal or no trimming after forming, in comparison to e.g. production of the same part via a deep drawing process. Additionally, the above method may allow for reduced metal waste whilst also maintaining satisfactory sheet qualities (e.g. reducing or avoiding unwanted material deformation such as wrinkling or tearing).

The term "basal region" is here used to define a region of the sheet metal workpiece which is a planar, base-like region. The basal region may undergo little or no bending and/or deformation during the forming process. In other words, the basal region may be a region of the workpiece which, during the forming operation, remains unchanged from its original size and shape. In some alternative forming processes, the basal region may undergo some shear deformation. The size and shape of the basal region is not particularly limited and may be selected as appropriate given the intended form of the formed sheet metal structure.

The term "curved" used here to define the curved fold region is considered to be synonymous to "rounded", and is used to generally refer to a region having some degree of curvature. The curvature may vary across the region. Accordingly, the terms curved or rounded are not used herein to solely refer to regions of constant curvature (i.e. they are not intended to be limited only to cylindrical or spherical regions).

The precise shape of the curved fold region is not particularly limited, and may take a number of different forms depending on the specific forming process and the desired final shape of the product. In some embodiments, the curved fold region may initially be approximately cone-shaped, or near-cone-shaped with an apex at an intersection of the sidewall portion(s) and the basal region. During deformation of the curved fold region, it may undergo a cone-to-cylinder deformation. In some embodiments, the curved fold region may initially be approximately cylindrical, and undergo cylinder to cylinder deformation.

The precise nature of the further deformation of the curved fold region during the step of progressively sliding the forming tool and/or the anvil tool along the curved fold region is not particularly limited, and will depend on the specific forming process and the desired final shape of the product. In some embodiments, the curved fold region may be deformed in such a way as to cause portions of the curved fold region to be flattened. Such flattened portions of the original curved fold region may lie in the same plane as the sidewall(s) of the sheet metal workpiece. Alternatively, such flattened portions of the original curved fold region may lie in the same plane as a basal region of the sheet metal workpiece. In some embodiments, the forming tool and/or the anvil tool may be progressively slid along only a portion of the curved fold region such that deformation of the curved fold region only takes place at or adjacent said portion.

The shear material transfer in the curved fold region may occur via material transfer from the curved fold region to at least one sidewall portion and/or material transfer to the curved fold region from at least one sidewall portion. However in some embodiments, the shear material transfer in the curved fold region may additionally or alternatively occur via shear material transfer to or from a basal region of the sheet.

Material transfer from the curved fold region to at least one sidewall portion may provide for improved shrink flange formation. Material transfer to the curved fold region from at least one sidewall portion may provide for improved stretch flange formation. By allowing for such material transfer, it may be possible to create flanges of a variety of shapes with little or no material thinning or thickening at the flange region, thus helping the reduce the occurrence of wrinkling and/or tearing during the forming process.

The term "sidewall portion" is used herein to generally define a portion of the workpiece which forms a sidewall with respect to a basal region of the sheet. In other words, it is a portion of the sheet which is inclined relative to a basal region of the sheet in such a way as to form a sidewall. The bending/folding performed to form such sidewall portions may be partially elastic or may be fully plastic. In some cases, folding may occur along a fold line adjacent the basal region of the sheet. Such fold line may define an edge of the basal region. The number of sidewall portions may be selected as appropriate given the desired final shape of the formed sheet metal structure. As discussed above, there may be at least first and second sidewall portions. Preferably the sidewall portion(s) respectively extend from the basal region (e.g. from a fold line defining an edge of the basal region) to the edge(s) of the sheet metal workpiece. In this way, the sidewall portion(s) can be considered to be flange portions connected to and extending from the basal region.

Bending of the workpiece to form the sidewall portion(s) may be performed by partially folding the sheet metal workpiece. This may be achieved by e.g. applying a bending moment to the first and/or second surface of the sheet metal at one or more locations between the basal region and the edge of the workpiece. Bending of the workpiece may be performed by engagement of the sheet metal workpiece between the anvil tool and the forming tool alone, during the step of contacting the sheet metal workpiece with the anvil tool and the forming tool. Alternatively, the bending moment may be applied using one or more bending tools. Accordingly the method may further comprise a step of providing one or more bending tools to perform the step of bending the workpiece to form the sidewall portion(s). Where one or more bending tools are used, the precise form of the bending tool(s) is not particularly limited and may comprise e.g. one or more rods or rollers, gripping members, or any other member(s) suitable for application of a bending moment to the sheet workpiece. Preferably, the bending tool(s) have an elongate form. This may allow for an even application of bending moment across the width of the sidewall portion(s). The bending moment may be applied using a plurality of bending tools. Where there are multiple bending tools, there may be one or more bending tools disposed either side of the sheet metal workpiece. For example, there may be two rods/rollers, with a single rod/roller respectively disposed on either side of the workpiece. Alternatively there may be 3 rods/rollers, two opposing one, or 4 or more rods/rollers. In this way, the position or force may be controlled between them to create curvature of the workpiece as the tool is moved along the surface.

Where one or more bending tool(s) are used to form the sidewall portion(s), they may be positioned to constrain the first and/or second surfaces of the sidewall portion(s) as the forming tool progressively slides over the curved fold region. Preferably, the sidewall portion(s) are respectively constrained at one or both of their first and second surfaces immediately adjacent the forming tool. Where the forming tool has a rounded tool surface, the sidewall portion(s) may be constrained immediately adjacent the rounded tool surface of the forming tool. Providing such additional surface constraint of the sidewall portion(s) can help to achieve the desired deformation of the curved fold region.

In a cross section through the thickness of the workpiece, during deformation the curved fold region may be S-shaped. That is, in a cross section through the thickness of the workpiece, a first portion of the curved fold region (for example, a portion adjacent the basal region) may have a first curvature, and a second portion of the curved fold region (for example, a portion adjacent the first/second edge region) may have a second curvature, wherein the second curvature is opposite to the first curvature. There may be a region of zero curvature connecting the first and second curvature portions. The first and second curvatures may not be equal in magnitude. Preferably the magnitude of the first curvature will be greater than the magnitude of the second curvature. Providing this reverse curvature can lower the effective apex of the curved fold region to below the plane of the basal region, thus reducing or preventing the material from attempting to lift or further deform in already worked areas. Where the curved fold region is S-shaped, the sidewall portion(s) may also be S-shaped.

After working, the sidewall portion(s) and the curved fold region may together define a continuous wall or flange, upstanding from the basal region (or downwardly-depending, based on the orientation of the workpiece). The continuous wall or flange may comprise a shrink flange, a stretch flange, or a composite shrink-stretch flange (sometimes referred to as an 'S' flange).

It may be advantageous to provide an additional tool set to hold the edge of the workpiece at the curved fold region during deformation of the curved fold region. For example, a clamping arrangement could be provided to hold the edge of the workpiece to provide an additional load on the curved fold region. This may result in an altered stress state of the material with the potential to further improving formability of the sheet metal.

The method may further comprise iteratively repeating steps of:

- bending the workpiece to form first and second sidewall portions respectively defined between the first and second edge regions and the basal region, and to define a curved fold region intermediate the first and second sidewall portions;
- providing a further anvil tool for contact with and constraint of the first surface of the sheet metal workpiece at the curved fold region;
- providing a further forming tool for contact with and constraint of the second surface of the sheet metal workpiece at the curved fold region;
- contacting the sheet metal workpiece with the anvil tool and the forming tool, and progressively sliding the further forming tool and/or the further anvil tool along the curved fold region to cause shear material transfer in the curved fold region to further deform the curved fold region.

By iteratively repeating the above steps, it may be possible to provide for formed sheet metal structure having greater deformation from its original form with reduced material wastage in comparison to e.g. deep drawing processes, and at the same time as reducing and/or preventing occurrence of unwanted sheet deformation (e.g. wrinkling or tearing). For example, in a single iteration of the above process it may be possible to provide a formed sheet metal structure having a flange bent at an angle of e.g. up to 30° or up to 40° from the plane of the basal region. By performing 2 further iterations of the above process steps (each iteration providing a further incremental deformation of up to e.g. 30°), it may therefore be possible to provide a formed sheet metal structure having a flange bent at an angle of up to e.g. 90° from the basal region plane. Where multiple iterations are used, the incremental deformation on each iteration may not be identical. For example, it is theorised that e.g. a first iteration could provide a greater angle deformation, with subsequent iterations providing smaller angle deformations.

The above process steps may be repeated 1, 2, 3, or 4 or more times. The further anvil tool and further forming tool(s) may be selected to be different in each iteration of the process, to accommodate for the increasing extent of deformation. They may be selected as appropriate to achieve the desired shape change in the sheet metal workpieces at each iteration—in this way, the same considerations apply to the further anvil tools and further forming tool(s) as apply to the first anvil tool and first forming tool discussed above. Alternatively, it is envisaged that in some embodiments, it may be possible to use anvil tools and forming tools which are the same for the first iteration as for further iterations. The precise number of iterations is not particularly limited, although may depend in part on e.g. the magnitude of deformation in each prior iteration, and the material selection. One or more intermediate material heat treatments may be applied between iterations, which may improve mechanical properties of the workpiece. For example, an annealing step may be performed between subsequent iterations of the formed process. This may be advantageous to reduce and/or eliminate work-hardening of the material, and thus increase the sheet's formability.

In a second preferred aspect, the present invention provides a workpiece obtained or obtainable using the method according to the first aspect. Workpieces obtainable using the method according to the first aspect may generally have reduced variation in material thickness across the workpiece compared to those produced by e.g. deep drawing methods—i.e. greater sheet uniformity. This is achieved by deforming the material primarily in a shear deformation mode, as opposed to in tension which can cause thinning and/or material failure for the same degree of deformation.

In a third preferred aspect, the present invention provides sheet metal working apparatus suitable for performing a method for manufacturing a formed sheet metal structure according to the first aspect, the sheet metal working apparatus comprising a first anvil tool and a first forming tool, and wherein the first anvil tool and first forming tool are configured to be moveable so as to maintain (i) a fixed distance between the forming tool and the anvil tool, or (ii) a fixed force on a sheet metal workpiece disposed between the forming tool and the anvil tool.

The anvil tool and/or the forming tool may comprise a rounded tool surface. The rounded tool surface of the anvil tool may be complementary to that of the forming tool. For example, the curvature of the rounded tool surface of the anvil tool may be opposite to the curvature of the rounded tool surface of the forming tool. Preferably the rounded tool surface has a curvature equal to the desired curvature of a portion of the curved fold region of the sheet metal workpiece after deformation.

The forming tool may comprise a frame, and the rounded tool surface of the forming tool may be located on a cross-bar portion of the frame. The rounded tool surface may have a radius of curvature equal to the desired radius of curvature of the second surface of the sheet metal workpiece at the curved fold region after deformation. The forming tool may comprise one or more constraining arms (e.g. a pair of arms) which, during use, engage with the second surface of the sheet metal workpiece to help prevent undesirable horizontal deformation of the curved fold region. Where the forming tool comprises one or more such arms, preferably, the rounded tool surface is located adjacent to a constraining arm, or intermediate two such arms (for example, on a cross-bar portion connecting said arms), such that constraint is provided adjacent to the rounded tool surface. The forming tool may therefore comprise an approximately 'V'- or 'U'-shaped frame portion. Where the forming tool comprises a pair of constraining arms, the arms may disposed at an angle to one another. For example, the arms may be disposed at an angle of from 60° to 150° to one another, more preferably from 70° to 140°, more preferably from 80° to 130°, and most preferably at an angle of from 90° to 120°.

Selecting such an angle may help to avoid wrinkling and/or tearing of the sheet metal workpiece during deformation.

However, the precise shape of the forming tool is not particularly limited, and indeed, any shape suitable for surrounding at least a part of the curved fold region may be suitable. In some embodiments, the forming tool may be a multi-part tool. It may comprise two or more parts. For example, the forming tool may comprise two 'L'-shaped portions which form a 'V'- or 'U'-shaped frame portion when brought together. In such embodiments, the respective parts of the forming tool may be used separately during selected stages of deformation of the workpiece, and may be brought together during other selected stages of deformation of the workpiece. Such embodiments may be particularly useful for formation of large-radius flanges, as discussed below in relation to FIG. 7.

Preferably the anvil tool and/or the forming tool has one or more angled 'lead-in' faces for guiding the workpiece between the forming tool and anvil tool. Providing an angled 'lead-in' face on the forming tool may help to prevent tearing of the sheet metal workpiece. Providing an angled 'lead-in' face on the anvil tool may help to prevent buckling of the sheet metal workpiece. The angled 'lead-in' face may be formed immediately adjacent a metal-contacting surface of the anvil tool or the forming tool which contacts and constrains a surface of the sheet metal workpiece. Such metal-contacting surface may be a rounded tool surface, where present. The angled 'lead-in' face may be formed at an angle of 10° to about 80°, more preferably 20° to 70° more preferably 30° to 60° more preferably 40° to 50°, and most preferably about 45° with respect to the plane in which the metal-contacting surface of the anvil tool or the forming tool lies. However, the angle of the lead-in face may be selected as appropriate for the particular forming process in which the anvil and/or forming tools are to be used. In many forming processes, the sheet metal workpiece may approach the metal contacting surface of the anvil tool and/or the forming tool at an angle; in such cases, the angled 'lead-in' face of the anvil tool and/or forming tool may be formed to be approximately 5° either side of the approach angle of the sheet metal workpiece. For example where the metal contacting surface of the anvil tool and forming tool lie in a horizontal plane, and the approach angle of the sheet metal workpiece is 18° above the horizontal plane, the lead-in face of the forming tool (upper die) may be formed to be 23° above the horizontal plane, and the lead-in face of the anvil tool (lower die) may be formed to be 13° above the horizontal plane. Providing such a lead-in face may help to prevent buckling or tearing of the workpiece during a step of progressively sliding the forming tool and/or the anvil tool against the curved fold region to deform the curved fold region. The forming tool and/or the anvil tool may additionally have one or more chamfered edges to reduce risk of tearing of the workpiece during deformation.

The anvil tool may comprise a solid lower die. Alternatively, the anvil tool may comprise a frame. The precise shape of the anvil tool is not particularly limited, and will be selected as appropriate given the desired shape of the formed sheet metal workpiece. However preferably, the anvil tool has a similar shape to the forming tool. Accordingly, the anvil tool may comprise a frame, and the rounded tool surface of the anvil tool may be located on a cross-bar portion of the frame. The anvil tool may comprise one or more constraining arms (e.g. a pair of arms) which, during use, engage with the first surface of the sheet metal workpiece to help prevent undesirable horizontal deformation of the curved fold region. Where the anvil tool comprises one or more such arms, preferably, the rounded tool surface is located adjacent to a constraining arm, or intermediate two such arms (for example, on a cross-bar portion connecting said arms), such that constraint is provided adjacent to the rounded tool surface. The anvil tool may therefore comprise an approximately 'V'- or 'U'-shaped frame portion. Where the anvil tool comprises a pair of constraining arms, the arms may disposed at an angle to one another. For example, the arms may be disposed at an angle of from 60° to 150° to one another, more preferably from 70° to 140°, more preferably from 80° to 130°, and most preferably at an angle of from 90° to 120°.

As discussed above in relation to the forming tool, the anvil tool may be a multi-part tool. It may comprise two or more parts. For example, the anvil tool may comprise two 'L'-shaped portions which form a 'V'- or 'U'-shaped frame portion when brought together. In such embodiments, the respective parts of the anvil tool may be used separately during selected stages of deformation of the workpiece, and may be brought together during other selected stages of deformation of the workpiece. Where the anvil tool comprises a solid lower die, a workpiece-engaging surface of the die may be selected to have a shape which matches the desired shape of the workpiece after forming.

The anvil tool may remain stationary during deformation of the curved fold region. Alternatively, and more preferably, the anvil tool may be progressively slid beneath the curved fold region at the same time as the forming tool is progressively slid above the curved fold region to assist in formation of the final desired shape of the workpiece. For example, the anvil tool may move in a fixed position relative to the forming tool. Alternatively, the anvil tool may be moved in such a way as to provide a controlled force on the workpiece in the direction of travel and/or perpendicular to the direction of travel of the anvil tool.

The sheet metal working apparatus may be configured to allow for each region of folding and shearing to be separately actuated. This can provide for greater flexibility in assessment of effectiveness of different tool features for manufacture of a specific component part.

Preferably, the sheet metal working apparatus is retrofittable to existing press-lines. For example, the bending stage could be performed by existing tools presently used in part of deep-drawing processes.

Preferably, the first anvil tool and the first forming tool are interchangeable for further anvil tools and further forming tools respectively.

In a fourth preferred aspect, the present invention provides a kit comprising the sheet metal working apparatus of the third aspect and one or more further anvil tools and one or more further forming tools.

Features indicated above as preferred and/or optional are combinable singly or in any combination with any aspect of the invention, unless the context demands otherwise.

BRIEF DESCRIPTION OF THE DRAWINGS

Embodiments of the invention will now be described by way of example with reference to the accompanying drawings in which.

DETAILED DESCRIPTION OF THE PREFERRED EMBODIMENTS, AND FURTHER OPTIONAL FEATURES OF THE INVENTION

The process described herein can be understood as "Folding-Shearing". The process may be used for the deformation of sheet metal blanks into the shell shapes currently made by deep-drawing (such as cans, boxes or car body parts) with a reduced need for trimming after shaping. As will be described in more detail below, with reference to FIG. 4-6, the process typically involves a small number of repeats of a two-step process:

- firstly, edges (e.g. straight edges) of the part are bent, leading to folds in regions where the straight edges meet;
- secondly, the material in these folds is drawn outwards by tools which create deformation nearly in pure shearing (without significant change in thickness of the sheet). Variations of the process configuration can allow for the formation of large radius corners and reverse corners (stretch flanges), as described below in relation to FIG. 7, 8, and FIGS. 10 to 12.

Figure 1:
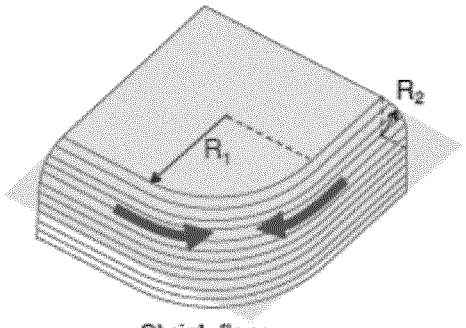
FIG. 1 illustrates a shrink flange.
Figure 2:
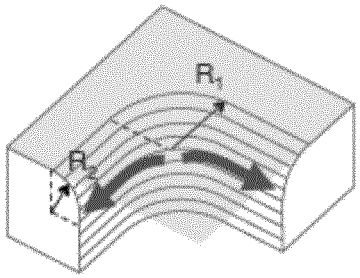
FIG. 2 illustrates a stretch flange.
Figure 3:
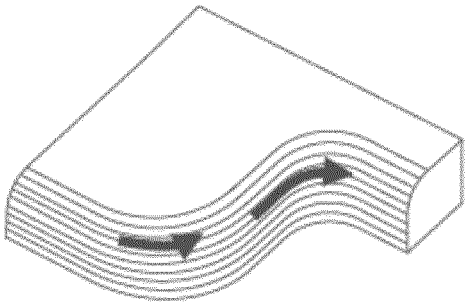
FIG. 3 illustrates an S-flange.
Figure 4:
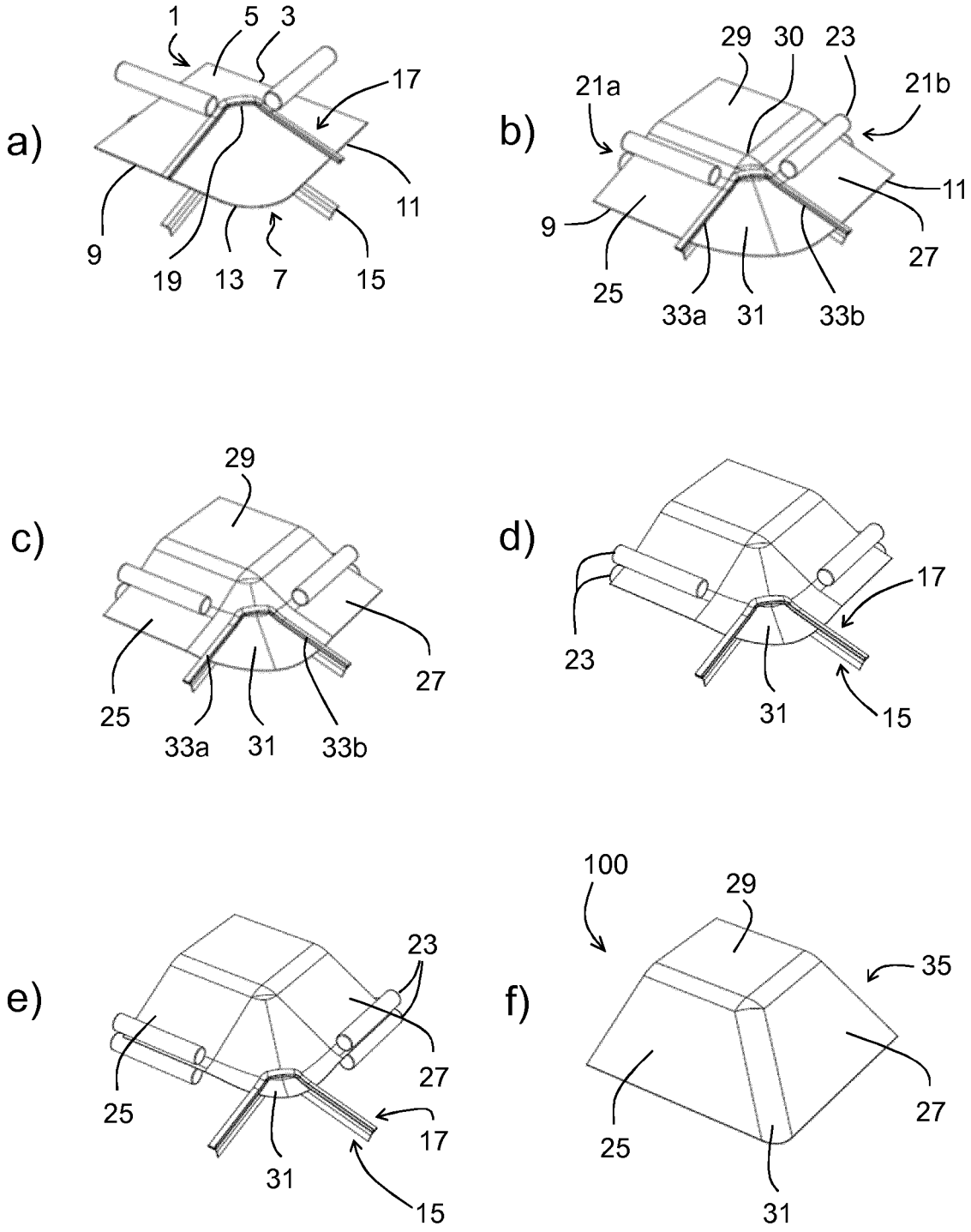
FIGS. 4 *a-f*) show consecutive process steps in a first stage of a method of manufacturing a formed sheet metal structure having a shrink flange.

The process will now be described with reference to FIGS. 4-6, which demonstrate consecutive process steps in first, second and third stages of a method of manufacturing a formed sheet metal structure respectively. The process starts initially with a flat sheet of metal, as shown in FIG. 4 (*a*), and the final formed sheet metal structure comprises a shrink flange upstanding from a basal region of the workpiece at about 90°, as shown in FIG. 6 (*f*). For simplicity, each of these figures illustrates a quarter of the whole process: the whole process if illustrated would show formation of a box-shaped workpiece with an upstanding peripheral flange. As it is, the present figures illustrate the formation of a single corner of the box.

In a first stage of the forming process, shown in FIG. 4, a flat sheet metal workpiece 1 is provided, the sheet metal workpiece having first and second surfaces 3, 5 opposed to each other—here, the first and second surfaces are lower (not visible) and upper faces of the sheet respectively. The sheet has a peripheral edge 7, the edge here comprising two straight edge regions 9, 11, and a rounded edge region 13 between the two straight edge regions (although we note that that the precise shape of these edge regions is non-essential, and may be selected as appropriate for the particular component part.

The flat sheet metal workpiece 1 is located in a sheet metal working apparatus (only part shown). The sheet metal working apparatus comprises a first anvil tool 15 having a rounded tool surface (not shown), and a first forming tool 17 having a rounded tool surface 19. The sheet metal working apparatus further comprises a plurality of bending tools: here, two sets of rollers 21*a, b*. Each set of rollers includes at least two rollers, with at least one roller 23 disposed on either side of the sheet metal workpiece. The rollers 23 are configured to be moveable relative to the workpiece to allow for application of a bending moment to the workpiece.

FIG. 4 (*b*) shows the step of bending the workpiece 1 using rollers 23 to form first and second sidewall portions 25, 27. The first 25 and second 27 sidewall portions extend from a planar basal region 29 to first and second edge regions 9, 11 of the sheet respectively. Here, due to the elongate shape of the rollers 23, a bending moment is applied across almost the entire width of each sidewall portion. This can help to control the bending of the sidewall portions to avoid unwanted sheet deformation.

As the first and second sidewall portions are created, an intermediate curved fold region 31 forms between the first and second sidewall portions. Here, the curved fold region has a generally convex curvature, as a shrink flange is being formed. The curved fold region is initially approximately cone-shaped with an apex at an intersection 30 of the first and second sidewall portions and the basal region.

During or soon after the initial bending step, the forming tool 17 is brought into contact with the second (upper) surface of the sheet metal workpiece at the curved fold region 31, and the anvil tool 15 is brought into contact with the first (lower) surface of the sheet metal workpiece at the curved fold region 31. Specifically, the rounded tool surface 19 of the forming tool contacts the curved fold region. The first anvil tool also has a rounded tool surface (not shown) which contacts the curved fold region. The forming tool is here conveniently formed as an approximately 'V'-shaped member or frame, the rounded tool surface 19 being located in a cross-bar of the tool, intermediate first and second constraining arms 33*a, b* which, during use, engage with the second surface 5 of the sheet metal workpiece 1 to help prevent undesirable deformation of the curved fold region and/or the sidewall portions. The first anvil tool 15 also has a rounded tool surface, although this is not visible.

FIGS. 4 (*b*)-(*e*) show the consecutive process steps during progressive sliding of the anvil tool 15 and forming tool 17 over the curved fold region 31 in a direction away from the basal region to deform the curved fold region.

Here, the anvil tool 15, like the forming tool 17, is also moveable relative to the sheet metal workpiece 1 and is also progressively slid beneath the curved fold region 113 at the same time as the forming tool is slid over the curved fold region 113. The forming tool and anvil tool are moved simultaneously so as to maintain a fixed distance between the tools. This can assist in formation of the final desired shape of the workpiece.

Additionally, the rollers 23 are also progressively moved to constrain the first and second surfaces 3, 5 of the first and second sidewall portions 25, 27 adjacent the rounded tool surface 19 of the forming tool 17, as the forming tool progressively slides over the curved fold region 31. Providing this additional surface constraint of the sidewall portions can help to achieve the desired deformation of the curved fold region by preventing unwanted deformation of the curved fold region and/or sidewall portions.

During the progressive sliding of the forming tool over the curved fold region, the first and second sidewall portions 25, 27 are approximately 'S'-shaped in a cross section taken through the thickness of the workpiece, from the basal region 29 to the respective edge region 9, 11 of the sidewall portion 25, 27. That is, a first portion of the sidewall portion adjacent the basal region has a first curvature, and a second portion of the sidewall portion adjacent the edge region has a second curvature, wherein the second curvature is opposite to the first curvature. Providing this "reverse curvature" of the sidewall portions can assist formation of the final desired shape of the workpiece.

During the further deformation of the curved fold region which occurs during sliding of the anvil tool and forming tool across the curved fold region, portions of the original curved fold region adjacent the sidewall portions of the sheet metal workpiece are flattened such that they lie in the same plane as the sidewall portions (see FIG. 4(*f*)). In this way, the final curved fold region formed after deformation has a different shape from the curved fold region before this forming step.

The formed sheet metal structure 100 at the end of this first stage of working (as shown in FIG. 4(*f*) comprises continuous wall or shrink flange 35 defined by the first and second sidewall portions 25, 27 and the curved fold region 31, and upstanding (or downwardly-depending, as shown in FIG. 4(*f*)) from basal region 29. Here, the flange lies in a plane about 30° offset from the plane of the basal region.

Figure 5:
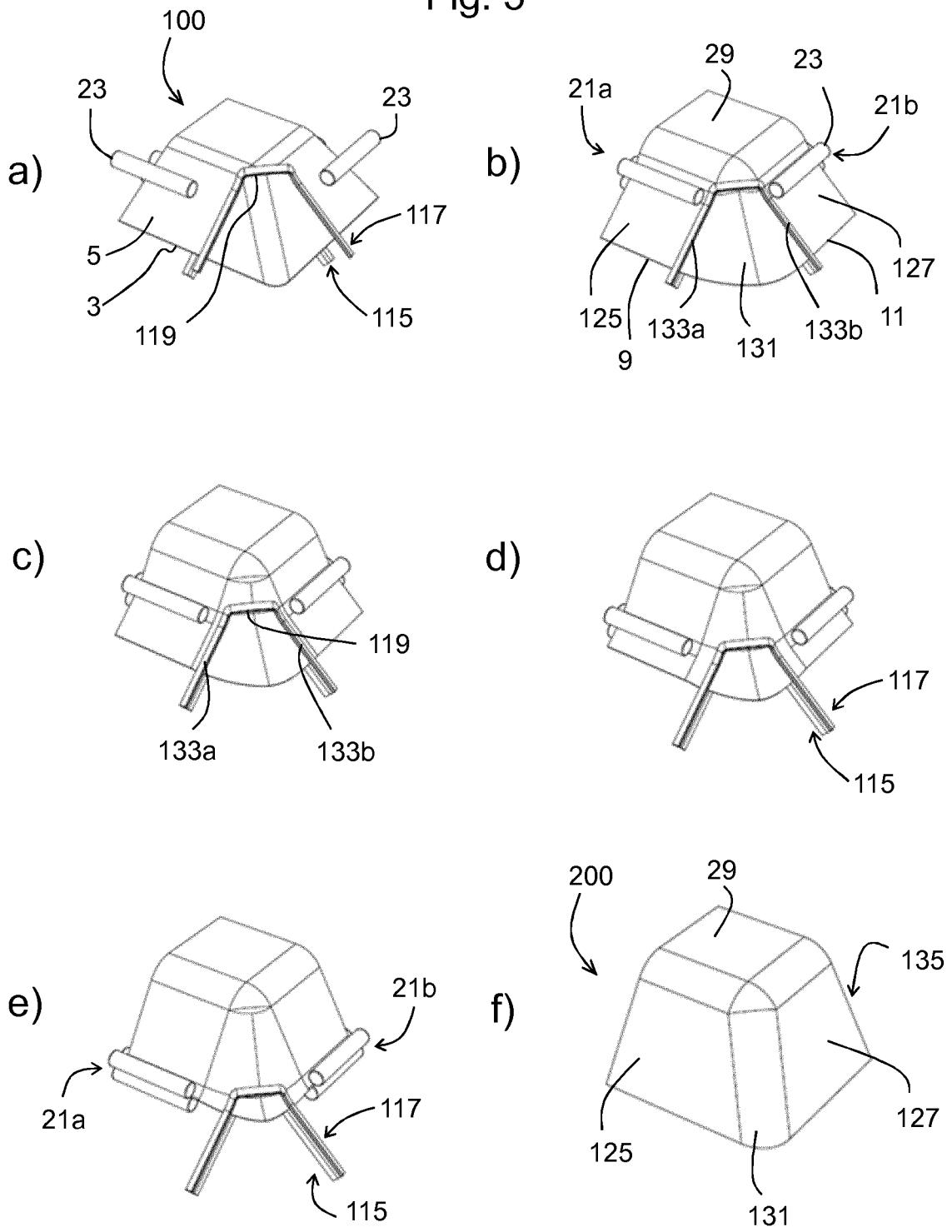
FIGS. 5 *a-f*) show consecutive process steps in a second stage of a method of manufacturing a formed sheet metal structure having a shrink flange.
Figure 6:
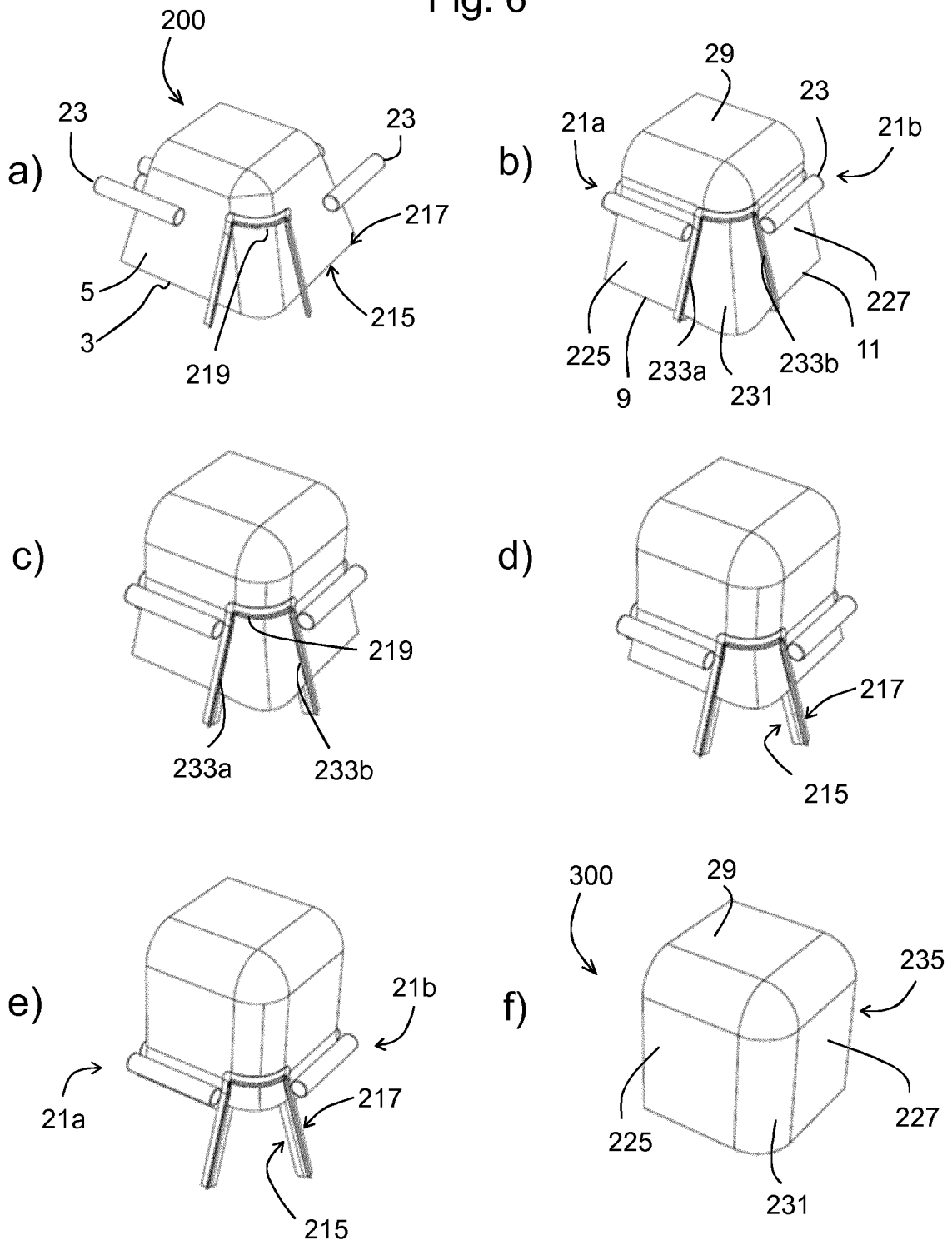
FIGS. 6 *a-f*) show consecutive process steps in a third stage of a method of manufacturing a formed sheet metal structure having a shrink flange.

The above process as described in relation to FIG. 4 is then iteratively repeated two further times, as shown in FIG. 5 and FIG. 6, and described below.

In the second stage of the forming process, shown in FIG. 5, the formed sheet metal structure 100 resulting from the first stage of the forming process (as shown in FIG. 4 (*f*)) is provided, optionally after one or more intermediate material heat treatments, and located in the sheet metal working apparatus. In some cases, the second stage of the forming process may be performed immediately after the first stage of the forming process, and accordingly the formed sheet metal structure 100 may already be located in the sheet metal working apparatus.

The first anvil tool and first forming tool used in the first stage of the forming process (FIG. 4) are respectively interchanged for further anvil tool 115 and further forming tool 117. The further anvil and forming tool are a similar overall shape to the shape of the first anvil and forming tools respectively. In particular, the forming tool is here conveniently formed as an approximately 'V'- or 'U'-shaped member or frame, the rounded tool surface 119 being located in a cross-bar of the tool, intermediate first and second constraining arms 133*a, b* which, during use, engage with the second surface 5 of the sheet metal workpiece to help prevent undesirable deformation of the curved fold region and/or the sidewall portions. The rounded tool surface 119 of the further forming tool is wider than the rounded tool surface 19 of the first forming tool as used in the first stage of the forming process. The further anvil tool 115 also has a rounded tool surface, although this is not visible.

As described above, the sheet metal working apparatus comprises a plurality of bending tools: here, two sets of rollers 21*a, b* are shown, each set of rollers including a roller 23 disposed on either side of the sheet metal workpiece 100.

FIG. 5 (*b*) shows the step of bending the workpiece 100 using rollers 23 to form first and second sidewall portions 125, 127. The first 125 and second 127 sidewall portions extend from the planar basal region 29 to first and second edge regions 9, 11 of the workpiece respectively. As in the first stage of the process, the elongate shape of rollers 23 means that a bending moment is applied almost across the entire width of each sidewall portion, to help avoid unwanted workpiece deformation.

During or soon after the bending step, the forming tool 117 is brought into contact with the second (upper) surface 5 of the sheet metal workpiece 100 at the curved fold region 131, and the anvil tool 115 is brought into contact with the first (lower) surface of the sheet metal workpiece at the curved fold region 131. Specifically, the rounded tool surface 119 of the forming tool contacts the curved fold region. FIGS. 5 (*b*)-(*e*) show the consecutive process steps during progressive sliding of the anvil tool 115 and forming tool 117 over the curved fold region 131 in a direction away from the basal region to deform the curved fold region. As above, during this, the first and second sidewall portions 125, 27 are approximately 'S'-shaped in a cross section taken through the thickness of the workpiece, from the basal region 29 to the respective edge region 9, 11 of the sidewall portion 125, 127.

As described above in relation to the first stage, the further anvil tool 115, like the forming tool 117, is also moveable relative to the sheet metal workpiece 100 and is also progressively slid beneath the curved fold region 131 at the same time as the forming tool is slid over the curved fold region. Furthermore, as also described above in relation to the first stage, the rollers 23 are also progressively moved to constrain the first and second surfaces 3, 5 of the first and second sidewall portions 125, 127 adjacent the rounded tool surface 119 of the forming tool 117, as the forming tool progressively slides over the curved fold region 131.

The formed sheet metal structure at the end of the second stage of working (as shown in FIG. 5(*f*) comprises continuous wall or shrink flange 135 defined by the first and second sidewall portions 125, 127 and the curved fold region 131, and upstanding from basal region 29. Here, the flange lies in a plane offset by about 60° from the plane of the basal region.

In the third stage of the forming process, shown in FIG. 6, the formed sheet metal structure 200 resulting from the second stage of the forming process (as shown in FIG. 5 (*f*)) is provided, optionally after one or more intermediate material heat treatments, and located in the sheet metal working apparatus. In some cases, the third stage of the forming process may be performed immediately after the second stage of the forming process, and accordingly the formed sheet metal structure 200 may already be located in the sheet metal working apparatus.

The further anvil tool and further forming tool used in the second stage of the forming process (FIG. 5) are respectively interchanged for second further anvil tool 215 and second further forming tool 217. The second further anvil and forming tools have a similar overall shape to the shape of the further anvil and forming tools respectively. In particular, the forming tool is here conveniently formed as an approximately 'U'-shaped member or frame, the rounded tool surface 219 being located in a cross-bar of the tool, intermediate first and second constraining arms 233*a, b* which, during use, engage with the second surface 5 of the sheet metal workpiece 200 to help prevent undesirable deformation of the curved fold region and/or the sidewall portions. The rounded tool surface 219 of the further forming tool is wider than the rounded tool surface 119 of the further forming tool as used in the second stage of the forming process. The further anvil tool 215 also has a rounded tool surface, although this is not visible.

FIG. 6 (*b*) shows the step of bending the workpiece 200 using rollers 23 to form first and second sidewall portions 225, 227. The first 225 and second 227 sidewall portions extend from the planar basal region 29 to first and second edge regions 9, 11 of the workpiece respectively. As in the first and second stages of the forming process, the elongate shape of rollers 23 means that a bending moment is applied almost across the entire width of each sidewall portion, to help avoid unwanted workpiece deformation.

During or soon after the bending step, the forming tool 217 is brought into contact with the second (upper) surface 5 of the sheet metal workpiece 200 at the curved fold region 231 and the anvil tool 215 is brought into contact with the first (lower) surface of the sheet metal workpiece at the curved fold region 231. Specifically, the rounded tool surface 219 of the forming tool contacts the curved fold region. FIGS. 6 (*b*)-(*e*) show the consecutive process steps during progressive sliding of the anvil tool 215 and forming tool 217 over the curved fold region 231 in a direction away from the basal region to deform the curved fold region. As above, during this, the first and second sidewall portions 225, 227 are approximately 'S'-shaped in a cross section taken through the thickness of the workpiece, from the basal region 29 to the respective edge region 9, 11 of the sidewall portion 225, 227.

As described above in relation to the first and second stages, the further anvil tool 215, like the forming tool 217, is also moveable relative to the sheet metal workpiece 200 and is also progressively slid beneath the curved fold region 231 at the same time as the forming tool is slid over the curved fold region. Furthermore, as also described above in relation to the first stage, the rollers 23 are also progressively moved to constrain the first and second surfaces 3, 5 of the first and second sidewall portions 225, 227 adjacent the rounded tool surface 219 of the forming tool 217, as the forming tool progressively slides over the curved fold region 231.

The formed sheet metal structure at the end of the third and final stage of working (as shown in FIG. 6(*f*)) comprises a continuous wall or shrink flange 235 defined by the first and second sidewall portions 225, 227 and the curved fold region 231, and upstanding from the basal region 29. Here, the flange lies in a plane offset by about 90° from the plane of the basal region.

Figure 7:
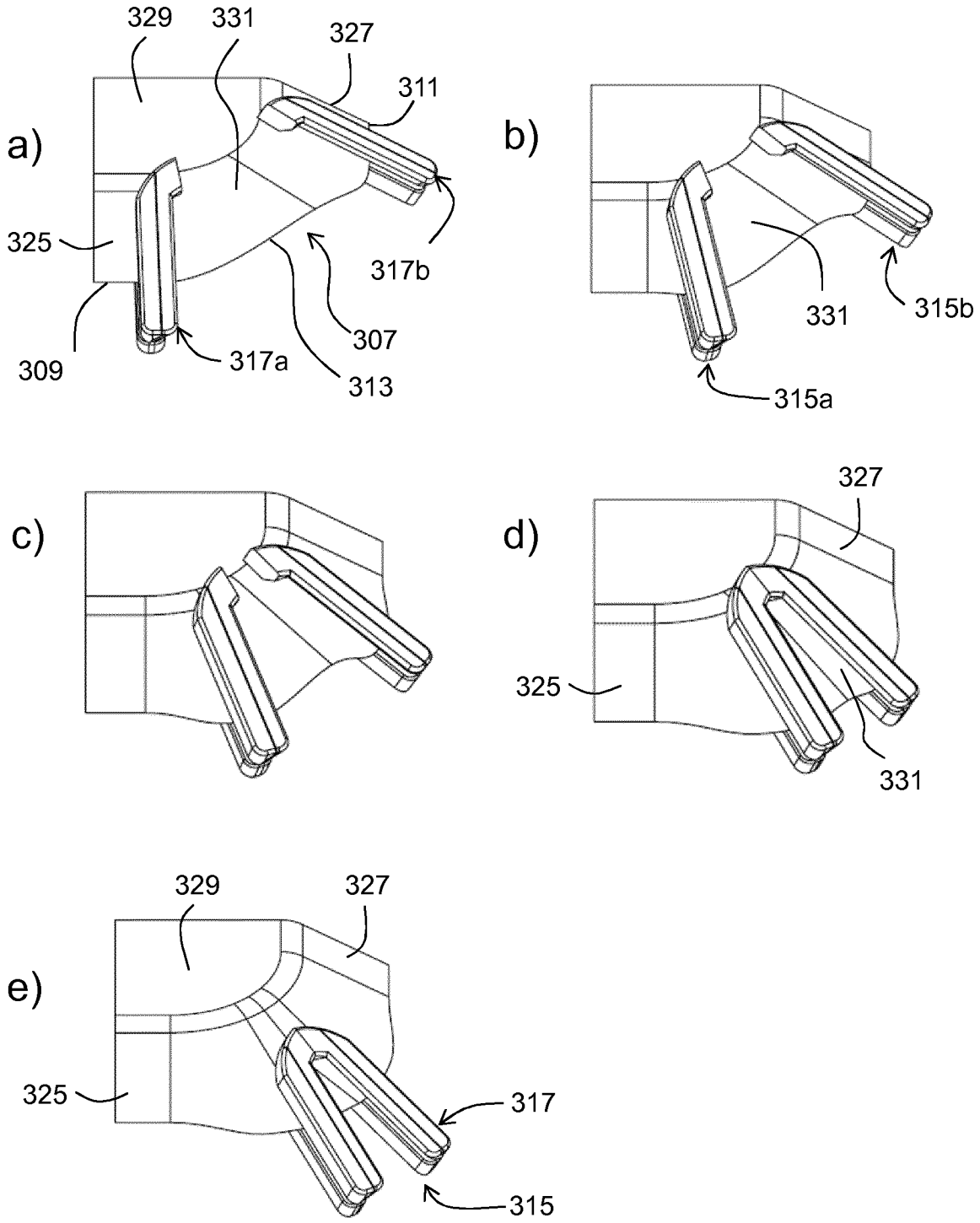
FIGS. 7 *a-e*) show consecutive process steps in a method of manufacturing a formed sheet metal structure having a large radius shrink flange.

FIGS. 7 *a-e*) show consecutive process steps in a method of manufacturing a formed sheet metal structure having a large radius shrink flange. The initial bending step performed on a flat sheet metal workpiece is not shown. The metal workpiece has first and second surfaces opposed to each other—here, the first and second surfaces are lower (not visible) and upper faces of the sheet respectively. The sheet has a peripheral edge 307, the edge here comprising two straight edge regions 309, 311, and a rounded edge region 313 between the two straight edge regions (although we note that that the precise shape of these edge regions is non-essential, and may be selected as appropriate for the particular component part. First and second sidewall portions 325, 327 extend between the first and second edge regions 309, 311 and a planar basal region 329 of the workpiece, and an intermediate curved fold region 331 is defined between them. The curved fold region here has a generally convex curvature, as a (large radius) shrink flange is being formed. The curved fold region is initially approximately cone-shaped with an apex at an intersection of the first and second sidewall portions and the basal region.

In this process, a two-part forming tool 317*a, b* and a two-part anvil tool 315*a, b* are used instead of one-piece tools such as those shown and described above in relation to FIGS. 4-6. The forming tool 317 and anvil tool 315 respectively comprise two 'L'-shaped portions (portion a, portion b) which form a 'V'-shaped frame when brought together. Each of the 'L'-shaped portions comprises a rounded tool surface (not shown) for contact with and constraint of the first or second surface of the sheet metal workpiece at the curved fold region.

The anvil tool 315 and forming tool 317 are moved towards one other until they contact the first and second sides of the sheet metal workpieces respectively in a position as shown in FIG. 7(*a*). Once the anvil tool and forming tool are in contact with the sheet metal workpiece, the 'L'-shaped portions are progressively slid against the curved fold region towards each other in a generally lateral direction relative to the basal region to deform the curved fold region. By this movement, material is 'gathered' at the large radius corner. Upon meeting each other, the 'L'-shaped portions of the forming tool and anvil tool join together to form respective single 'V'-shaped forming and anvil tools. The forming and anvil tools are then progressively slid across the curved fold region in a direction away from the basal region to further deform the curved fold region.

The formed sheet metal structure at the end of this stage of working (not shown) comprises a continuous wall or shrink flange defined by the first and second sidewall portions 325, 327 and the curved fold region 331, and upstanding from the basal region 329. Here, the flange lies in a plane offset by about 30° from the plane of the basal region.

Figure 8:
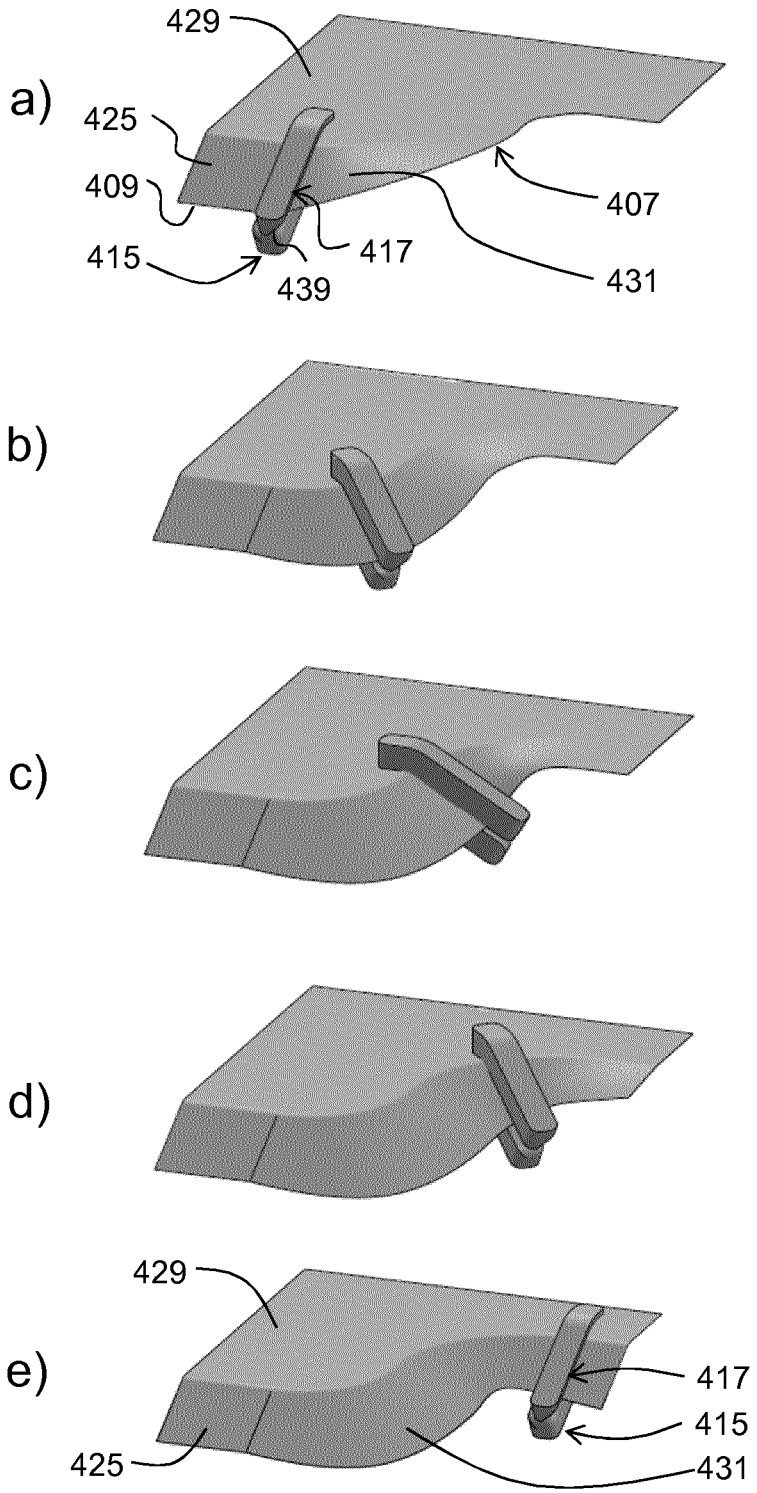
FIGS. 8 *a-e*) show consecutive process steps in a method of manufacturing a formed sheet metal structure having a composite shrink-stretch flange.

FIGS. 8 *a-e*) show consecutive process steps in a method of manufacturing a formed sheet metal structure having a composite shrink-stretch flange. The initial bending step performed on a flat sheet metal workpiece is not shown. The metal workpiece has first and second surfaces opposed to each other—here, the first and second surfaces are lower (not visible) and upper faces of the sheet respectively. The sheet has a peripheral edge 407, the edge here comprising at least one straight edge region 409. A first sidewall portion 425 extends between the edge region 409 and a planar basal region 429 of the workpiece. A curved fold region 431 is defined adjacent to the sidewall portion 425. The curved fold region initially has a generally convex curvature.

The anvil tool 415 and forming tool 417 are moved towards one other until they contact the first and second sides of the sheet metal workpieces respectively in a position as shown in FIG. 8(*a*). Once the anvil tool and forming tool are in contact with the sheet metal workpiece, they are progressively slid along the curved fold region laterally to the basal region 429 along an 'S'-shaped path, firstly moving the bulging curved fold region forwards round the corner of the shrink-flange portion, and then "giving up" material to form a stretch flange portion. Here, the forming tool 417 has an angled lead-in face 439 to help guide the sheet metal workpiece beneath the forming tool, as described in further detail below in relation to FIG. 9.

The formed sheet metal structure at the end of this stage of working comprises a continuous wall or shrink flange defined by the first sidewall portions 425 and the curved fold region 431, and upstanding from the basal region 429. Here, the flange lies in a plane offset by about 30° from the plane of the basal region.

Figure 9:
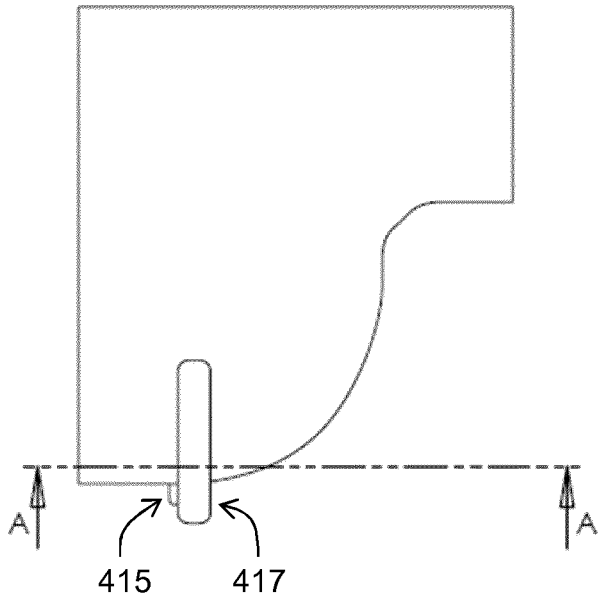
FIG. 9 *a-c*) show a plan view of one step of the process shown in FIG. 8, including cross-sectional detail of the anvil and forming tools.
Figure 9:
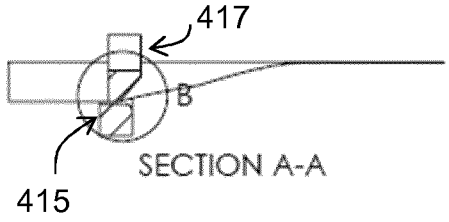
Figure 9:
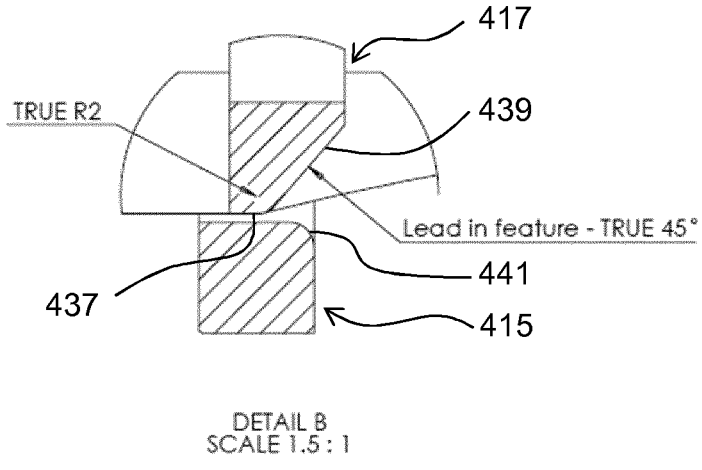

FIGS. 9 *a-c*) show a plan view of one step of the process of forming a sheet metal workpiece shown in FIG. 8, and cross-sectional detail of the anvil and forming tools. FIG. 9 (*b*) shows a cross-section taken along line A-A in FIG. 9 (*a*). The forming tool 417 comprises a metal contact surface 437 which, during deformation, contacts and constrains the second surface of the sheet metal workpiece. The forming tool further comprises an angled lead-in face 439 formed at an angle of 45° with respect to the plane in which the metal contact surface lies. During the deformation process, as the forming tool is progressively slid across the sheet metal workpiece, the angled lead-in face guides the sheet metal to contact the metal contacting surface of the forming tool, and helps to prevent unwanted buckling and/or tearing of the sheet.

As best seen in FIG. 9 (*c*), the leading corner 441 of the anvil tool 415 is also chamfered to help prevent unwanted tearing of the sheet metal workpiece.

Stretch flanges also exist in isolation, as internal corners (such as the wheel-arch shape of a car-body front wing). This could be created by a similar gathering of material being moved inwards towards the stretch flange as described above in relation to the method for forming a composite shrink-stretch flange.

Figure 10:
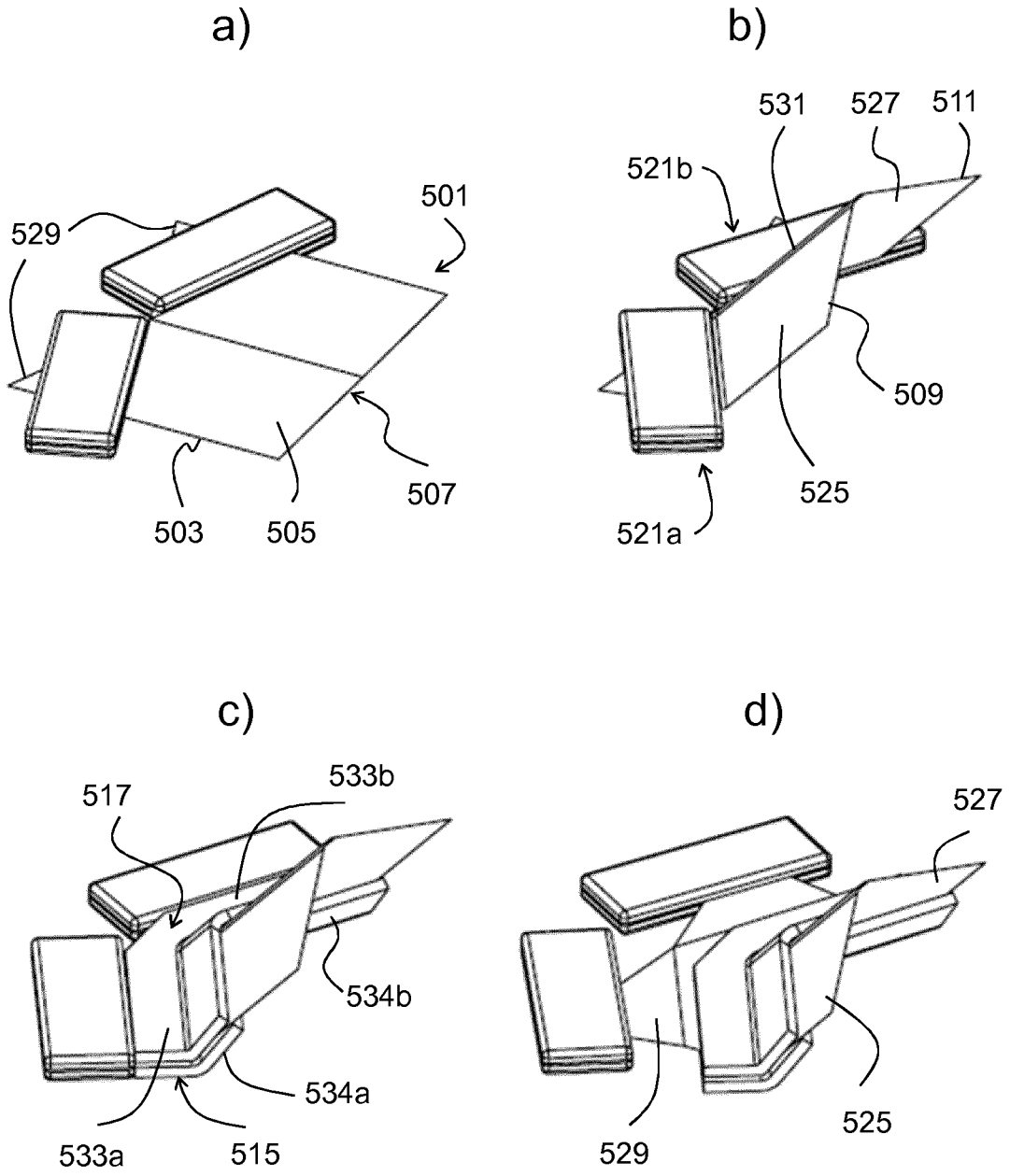
FIGS. 10 *a-d*) show consecutive process steps in a first stage of a method of manufacturing a formed sheet metal structure having a stretch flange.
Figure 11:
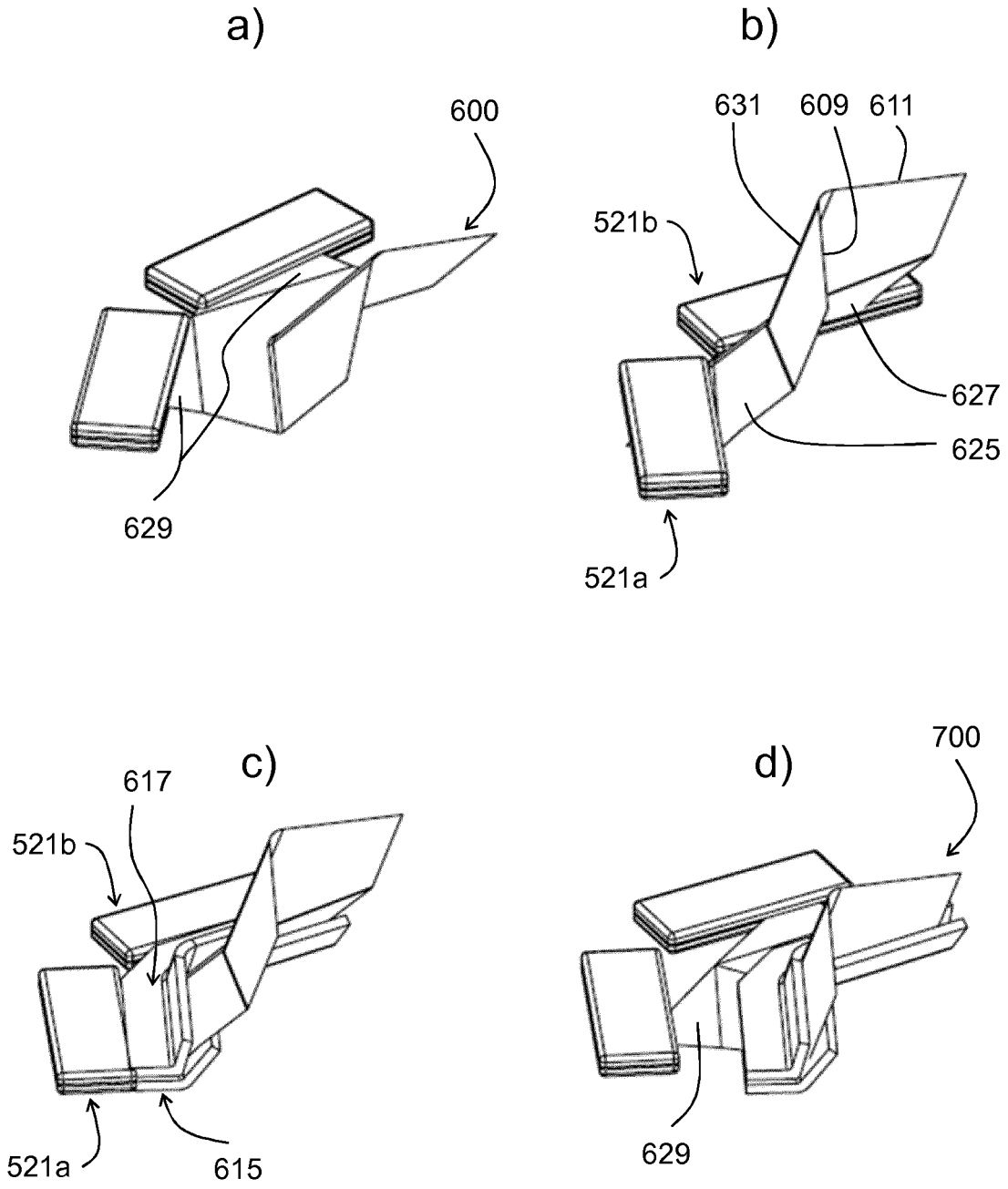
FIGS. 11 *a-d*) show consecutive process steps in a second stage of a method of manufacturing a formed sheet metal structure having a stretch flange.
Figure 12:
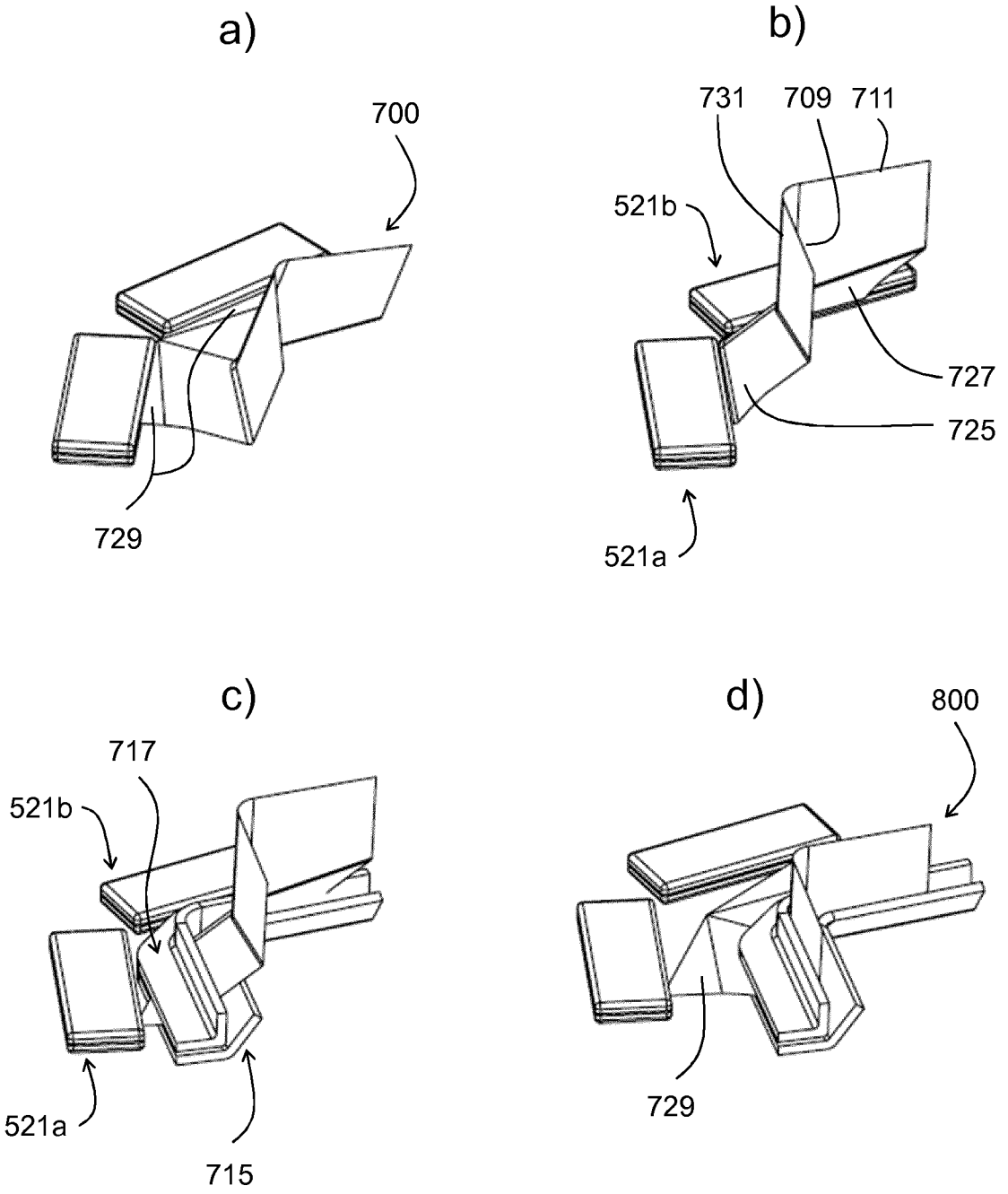
FIGS. 12 *a-d*) show consecutive process steps in a third stage of a method of manufacturing a formed sheet metal structure having a stretch flange.

FIGS. 10-12 show consecutive process steps in first, second and third stages of a method of manufacturing a formed sheet metal structure having a stretch flange. The process starts initially with a flat sheet of metal, as shown in FIG. 10 (*a*), and the final formed sheet metal structure comprises a stretch flange upstanding from a basal region of the workpiece at about 90°, as shown in FIG. 12 (*d*).

Figure 13:
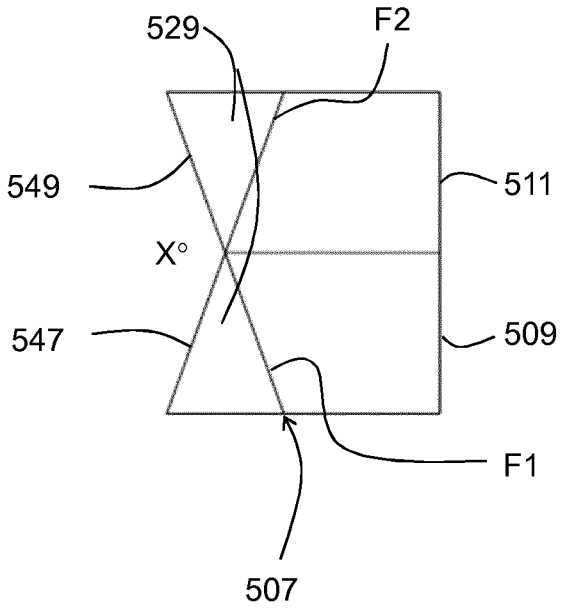
FIG. 13 shows plans view of an initial sheet metal workpieces as used in the method shown in FIGS. 10-12.

In a first stage of the forming process, shown in FIG. 10, a flat sheet metal workpiece 501 is provided, the sheet metal workpiece having first and second surfaces 503, 505 opposed to each other—here, the first and second surfaces are lower (not visible) and upper faces of the sheet respectively. The sheet has a peripheral edge 507, the edge here comprising a plurality of straight edge regions (as best seen in FIG. 13). Two of the edge regions 547, 549 are disposed in a 'V' formation, at an angle of approximately 120° to one another.

The flat sheet metal workpiece 501 is located in a sheet metal working apparatus (only part shown). The sheet metal working apparatus comprises a plurality of bending tools: here, two sets of gripping members 521*a, b*, each arranged for gripping a portion of the sheet metal workpiece. The gripping members 521*a, b* are configured to be moveable relative to the workpiece to allow for application of a bending moment to the workpiece.

FIG. 10(*b*) shows the step of bending the workpiece 501 using gripping members 521*a, b* to form first and second sidewall portions 525, 527. This bending is performed by rotating respective sets of gripping members 521*a, b* inward towards one another. This causes the sheet metal workpiece to fold along first and second fold lines F1 and F2 adjacent a planar basal region 529 of the sheet (here, a discontinuous planar basal region initially formed as two separate portions of the sheet), thus forming first and second sidewall portions extending from said first and second fold lines F1, F2 to first and second edge regions 509, 511 of the sheet respectively. As the first and second sidewall portions are created, an intermediate curved fold region 531 forms between the first and second sidewall portions.

The sheet metal working apparatus comprises a first anvil tool 515 and a first forming tool 517. Each of the first anvil tool and first forming tools comprises a metal contacting tool surface which lies in an approximately horizontal plane for contact with and constraint of the sheet metal workpiece at the first and second surfaces respectively. Each of the first anvil tool and first forming tool further comprises an angled lead-in face for guiding of the sheet metal workpiece between the anvil tool and the forming tool. Here, the forming tool and anvil tool are conveniently formed as an approximately 'V'-shaped members having first and second constraining arms 533*a, b*; 534*a, b* which, during use, engage with respective surfaces of the sheet metal workpiece to help prevent undesirable deformation of the curved fold region and/or the sidewall portions. The angle between the constraining arms of each of the forming tool and the anvil tool is about 119°.

During or soon after the initial bending step, the forming tool 517 is brought into contact with the second (upper) surface of the sheet metal workpiece at the curved fold region 531, and the anvil tool 515 is brought into contact with the first (lower) surface of the sheet metal workpiece at the curved fold region 531.

The anvil tool 515 and forming tool 517 are then progressively slid along a portion of the curved fold region 531 in a direction away from the basal region such that the curved fold region and adjacent sidewall portions 525, 527 are partially flattened so as to lie in the same plane as the basal region of the sheet metal workpiece (see FIG. 10(*d*)). The anvil tool and forming tool are moved simultaneously so as to maintain a fixed distance between the tools. This can assist in formation of the final desired shape of the workpiece.

The formed sheet metal structure 600 at the end of this first stage of working (as shown in FIG. 11(*a*)) comprises continuous wall or stretch flange defined by the non-flattened portions of the first and second sidewall portions 525, 527 and the curved fold region 531, upstanding from basal region 529. Here, the flange lies in a plane offset by about 46° from the plane of the basal region, as measured between the basal region and the curved fold region of the flange.

The above process as described in relation to FIG. 10 is then iteratively repeated two further times, as shown in FIG. 11 and FIG. 12, and described below.

In the second stage of the forming process, shown in FIG. 11, the formed sheet metal structure 600 resulting from the first stage of the forming process is provided, optionally after one or more intermediate material heat treatments, and located in the sheet metal working apparatus. In some cases, the second stage of the forming process may be performed immediately after the first stage of the forming process, and accordingly the formed sheet metal structure 600 may already be located in the sheet metal working apparatus.

FIG. 11 (*b*) shows the step of bending the workpiece 600 to form first and second sidewall portions 625, 627. Similarly to the first stage of the process, this bending is performed by rotating respective sets of gripping members 521*a, b* inward towards one another. This causes the sheet metal workpiece to fold along first and second fold lines adjacent the planar basal region 629 of the sheet, thus forming first and second sidewall portions 625, 627 extending from said first and second fold lines to first and second edge regions 609, 611 of the sheet respectively, and defining an intermediate curved fold region 631.

FIG. 11(*c*) shows the sheet metal workpiece being contacted by further anvil tool 615 and further forming tool 617, which have replaced the first anvil tool 515 and the first forming tool 517 used in the first stage of the forming process. Similarly to the first anvil tool and forming tool used in the first stage of the forming process, the further forming tool 617 and anvil tool 615 each comprise a metal contacting tool surface which lies in an approximately horizontal plane for contact with and constraint of the sheet metal workpiece at the first and second surfaces respectively, and an angled lead-in face for guiding of the sheet metal workpiece between the further anvil tool and the further forming tool. Furthermore, the further forming tool 617 and further anvil tool 615 are conveniently formed as an approximately 'V'-shaped members having first and second constraining arms which, during use, engage with respective surfaces of the sheet metal workpiece to help prevent undesirable deformation of the curved fold region and/or the sidewall portions. The angle between the constraining arms of each of the forming tool and the anvil tool is about 114°.

The anvil tool 615 and forming tool 617 are then progressively slid along a portion of the curved fold region 631 in a direction away from the basal region such that the curved fold region and adjacent sidewall portions 625, 627 are partially flattened so as to lie in the same plane as the basal region of the sheet metal workpiece (see FIG. 11(*d*)). The anvil tool and forming tool are moved simultaneously so as to maintain a fixed distance between the tools. This can assist in formation of the final desired shape of the workpiece.

The formed sheet metal structure 700 at the end of this second stage of working (as shown in FIG. 12(*a*)) comprises a continuous wall or stretch flange defined by the non-flattened portions of the first and second sidewall portions 625, 627 and the curved fold region 631, upstanding from basal region 629. Here, the flange lies in a plane offset by about 70° from the plane of the basal region, as measured between the basal region and the curved fold region of the flange.

In the third stage of the forming process, shown in FIG. 12, the formed sheet metal structure 700 resulting from the first stage of the forming process is provided, optionally after one or more intermediate material heat treatments, and located in the sheet metal working apparatus. In some cases, the second stage of the forming process may be performed immediately after the first stage of the forming process, and accordingly the formed sheet metal structure 700 may already be located in the sheet metal working apparatus.

FIG. 12 (*b*) shows the step of bending the workpiece 700 to form first and second sidewall portions 725, 727. Similarly to the first and second stages of the process, this bending is performed by rotating respective sets of gripping members 521*a, b* inward towards one another. This causes the sheet metal workpiece to fold along first and second fold lines adjacent the planar basal region 729 of the sheet, thus forming first and second sidewall portions 725, 727 extending from said first and second fold lines to first and second edge regions 709, 711 of the sheet respectively, and defining an intermediate curved fold region 731.

FIG. 12(*c*) shows the sheet metal workpiece being contacted by second further anvil tool 715 and second further forming tool 717, which have replaced the further anvil tool 615 and the further forming tool 617 used in the second stage of the forming process. Similarly to the first/further anvil tool and forming tools used in the first and second stages of the forming process, the second further forming tool 717 and second further anvil tool 715 each comprise a metal contacting tool surface which lies in an approximately horizontal plane for contact with and constraint of the sheet metal workpiece at the first and second surfaces respectively, and an angled lead-in face for guiding of the sheet metal workpiece between the further anvil tool and the further forming tool. Furthermore, the second further forming tool 717 and second further anvil tool 715 are conveniently formed as an approximately 'V'-shaped members having first and second constraining arms which, during use, engage with respective surfaces of the sheet metal workpiece to help prevent undesirable deformation of the curved fold region and/or the sidewall portions. The angle between the constraining arms of each of the forming tool and the anvil tool is about 99°.

The second further anvil tool 715 and second further forming tool 717 are then progressively slid along a portion of the curved fold region 731 in a direction away from the basal region such that the curved fold region and adjacent sidewall portions 725, 727 are partially flattened so as to lie in the same plane as the basal region of the sheet metal workpiece (see FIG. 12(*d*)). The anvil tool and forming tool are moved simultaneously so as to maintain a fixed distance between the tools. This can assist in formation of the final desired shape of the workpiece.

The formed sheet metal structure 800 at the end of this third stage of working comprises a continuous wall or stretch flange defined by the non-flattened portions of the first and second sidewall portions 725, 727 and the curved fold region 731, upstanding from basal region 729. Here, the flange lies in a plane offset by about 87° from the plane of the basal region, as measured between the basal region and the curved fold region of the flange.

The process described above is capable of producing flanges which lie in a plane offset by 90° from the basal region, i.e. flange formed at approximately at right angles to the basal region.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

REFERENCES

One or more publications are cited above in order to more fully describe and disclose the invention and the state of the art to which the invention pertains. Full citations for these references are provided below. The entirety of each of these references is incorporated herein.

Horton, P. M. and Allwood, J. M. (2017): "Yield improvement opportunities for manufacturing automotive sheet metal components", Journal of Materials Processing Technology, 249 78-88.

The invention claimed is:

1. A method of manufacturing a formed sheet metal structure, comprising the steps of:

providing a sheet metal workpiece having first and second surfaces opposed to each other and at least one edge;

providing one or more bending tools to perform bending the workpiece to form at least a first sidewall portion defined between the edge and a basal region, the bending of the workpiece also forming a curved fold region in the sheet metal workpiece adjacent the first sidewall portion;

providing a first anvil tool with a tool surface for contact with and constraint of the first surface of the sheet metal workpiece;

providing a first forming tool with a tool surface for contact with and constraint of the second surface of the sheet metal workpiece;

contacting the sheet metal workpiece with the anvil tool and the forming tool, and progressively sliding the forming tool and/or the anvil tool along the curved fold region to cause shear material transfer in the curved fold region to further deform the curved fold region;

wherein the anvil tool and the forming tool have respective rounded tool surfaces with a curvature equal to the desired curvature of the curved fold region of the sheet metal workpiece after deformation; and wherein the one or more bending tools constrain the first sidewall portion as the forming tool progressively slides over the curved fold region.

2. The method according to claim 1, wherein the at least one edge comprises first and second edge regions, and wherein the method further comprises:

bending the workpiece to form a second sidewall portion defined between the first and second edge regions and the basal region, the curved fold region being located intermediate the first and second sidewall portions.

3. The method according to claim 2, further comprising iteratively repeating steps of:

bending the workpiece to form first and second sidewall portions respectively defined between the first and second edge regions and the basal region, and to form and define a curved fold region intermediate the first and second sidewall portions;

providing a further anvil tool for contact with and constraint of the first surface of the sheet metal workpiece at the curved fold region;

providing a further forming tool for contact with and constraint of the second surface of the sheet metal workpiece at the curved fold region;

contacting the sheet metal workpiece with the further anvil tool and the further forming tool, and progressively sliding the further forming tool and/or the further anvil tool along the curved fold region to cause shear material transfer in the curved fold region to further deform the curved fold region.

4. The method of manufacturing a formed sheet metal structure according to claim 2 wherein after working, the first and second sidewall portion and the curved fold region together define a continuous wall, upstanding from the basal region.

5. The method according to claim 1 wherein the first forming tool and/or the first anvil tool are progressively slid along the curved fold region in a direction away from the basal region during at least a portion of the sliding step.

6. The method according to claim 1 wherein the first forming tool and/or the first anvil tool are progressively slid along the curved fold region laterally to the basal region during at least a portion of the sliding step.

7. The method of manufacturing a formed sheet metal structure according to claim 1 wherein the shear material transfer occurs as:

(i) material transfer from the curved fold region to at least one sidewall portion; or (ii) material transfer to the curved fold region from at least one sidewall portion.

8. The method of manufacturing a formed sheet metal structure according to claim 1 wherein the first and second sidewall portion respectively extend from the basal region to the edge of the workpiece.

9. The method of manufacturing a formed sheet metal structure according to claim 1 wherein in a cross section though the thickness of the workpiece, the curved fold region is 'S'-shaped.

10. The method of manufacturing a formed sheet metal structure according to claim 1, wherein the bending tool(s) comprise one or more rods, one or more rollers, or one or more gripping members.

11. The method of manufacturing a formed sheet metal structure according to claim 1 wherein the anvil tool and/or the forming tool are multi-part tools.

12. The method of manufacturing a formed sheet metal structure according to claim 1 including the step of providing an additional tool set to hold the edge of the workpiece at the curved fold region during deformation of the curved fold region.

* * * * *